US008403515B2

(12) United States Patent
Eichelberger et al.

(10) Patent No.: US 8,403,515 B2
(45) Date of Patent: Mar. 26, 2013

(54) ADJUSTABLE LIGHT

(75) Inventors: Cleatis A. Eichelberger, Mt. Laurel, NJ (US); Gregory Janice, Shamong, NJ (US)

(73) Assignee: Princeton Tectonics, Inc., Bordentown, NJ (US)

( * ) Notice: Subject to any disclaimer, the term of this patent is extended or adjusted under 35 U.S.C. 154(b) by 391 days.

(21) Appl. No.: 12/699,317

(22) Filed: Feb. 3, 2010

(65) Prior Publication Data

US 2011/0188236 A1 Aug. 4, 2011

(51) Int. Cl.
*F21V 21/084* (2006.01)
*F21V 21/32* (2006.01)
*F21L 4/04* (2006.01)

(52) U.S. Cl. ..... 362/106; 362/198; 362/269; 362/388; 362/418

(58) Field of Classification Search ..... 362/198, 362/199, 103, 105, 269, 388, 418, 430, 106, 362/107; 2/422
See application file for complete search history.

(56) References Cited

U.S. PATENT DOCUMENTS 3,731,084 A * 5/1973 Trevorrow ..... 362/108
4,406,040 A * 9/1983 Cannone ..... 24/3.12
4,530,112 A * 7/1985 Cecala et al. ..... 362/107
5,463,538 A * 10/1995 Womack ..... 362/106
5,720,543 A * 2/1998 Sheps ..... 362/196
6,808,289 B2 * 10/2004 Reed ..... 362/198
6,953,259 B2 10/2005 Parsons
7,086,749 B1 * 8/2006 Hanley ..... 362/105
7,125,139 B2 10/2006 Kumthampinij
7,461,944 B2 * 12/2008 Alessio ..... 362/184
7,497,584 B1 * 3/2009 Quittner ..... 362/103
7,549,763 B2 6/2009 Kim
7,562,995 B1 * 7/2009 Levine ..... 362/197
7,581,847 B2 9/2009 Dalton
7,645,050 B2 * 1/2010 Wilt et al. ..... 362/103
7,699,485 B1 * 4/2010 Lagassey ..... 362/103
2007/0115672 A1 * 5/2007 Nelson et al. ..... 362/396
2007/0159810 A1 7/2007 Kim

* cited by examiner

*Primary Examiner* — Peggy A. Neils
(74) *Attorney, Agent, or Firm* — Howson & Howson LLP

(57) ABSTRACT

In an adjustable light, a mounting base is formed with a pair of arcuate slots for receiving hooks protruding from a light module. For attachment of the light module to the base, the hooks enter open ends of the respective slots, and the light module is rotated to engage the hooks with the slots. A sheet of spring metal with two series of protrusions is sandwiched between a rear part of the base and a front part in which the slots are formed. The protrusions are exposed through the slots, and a space is provided behind the protrusions, allowing them to move resiliently when engaged by the hooks as the light module is rotated so that the light module can be retained in any selected one of a plurality of angular positions.

6 Claims, 6 Drawing Sheets

ADJUSTABLE LIGHT

FIELD OF THE INVENTION

This invention relates to lighting and particularly to a portable light suitable for attachment to a helmet, an article of apparel, or other object, and capable of adjustment in order to project light in any desired direction within a range.

BACKGROUND OF THE INVENTION

Recent efforts by lighting manufacturers have led to the development of various portable lighting devices designed for attachment to a helmet or other article of apparel, such as a vest having multiple external straps known as a "MOLLE" vest, MOLLE being an acronym for MOdular Lightweight Load-carrying Equipment. Examples are described in U.S. Pat. Nos. 6,953,259, 7,549,763, and 7,581,847 and in United States patent publication 2007/0159810. Many such lighting devices are composed of a mounting base that can be securely attached to a helmet, a vest, or the like, and a self-contained light and power source combination that can be attached to the mounting base, adjusted while attached to the mounting base to project light in a desired direction, and removed from the mounting base by a deliberate manipulation for hand-held use, for replacement by another light source, or for mounting on a different mounting base.

SUMMARY OF THE INVENTION

The adjustable light in accordance with the invention also comprises a mounting base and a self-contained light and power source module, which can be referred to as a light module. It has the same general objectives as those of the lighting devices mentioned above, but affords improved directional adjustment along with one or more of a number of other desirable features such as ease of attachment and detachment of the light module from the mounting base, secure attachment of the light module to the mounting base, ease of adjustment, stable retention of the light module in any selected position of adjustment, versatility, robustness, lightness in weight, structural simplicity, and the capability of the mounting base to be adapted easily for attachment to any of a wide variety of articles of clothing, headgear or other supports, without changing the basic structure used for removable attachment and adjustment of the light module.

The adjustable light according to the invention comprises a light module and a mounting base. The light module comprises a housing, a light emitter such as a light-emitting diode (LED), an electric power source such as a lithium button cell, and a switch for selectably connecting the power source to the light emitter. The mounting base has a back side attachable to a supporting article, and a front side on which the light module is removably mountable.

In a preferred embodiment, the front face of the mounting base is formed with a pair of slots, each having an elongated arcuate edge extending along its length. The arcuate edges of the two slots are concentric, and the slots are undercut along their arcuate edges so that each slot has an internal retaining surface extending along its elongated arcuate edge and facing toward the back side of the mounting base.

The light module has first and second hooks protruding therefrom, extending respectively into the slots of the mounting base, and engaging the respective internal retaining surfaces of said slots to prevent separation of the light module from the mounting base while permitting rotation of the light module relative to the base about an axis of rotation extending through a center point defined by the concentric arcuate edges.

Each of the slots has a hook entry clearance at one of its ends to permit entry of the hooks into the slots by movement of the light module in the direction of the axis of rotation followed by rotation of the light module. The arcuate edges of the slots extend from the clearances in the same circumferential direction, so that the hooks can be engaged with the retaining surfaces by rotation of the light module in that same circumferential direction.

The mounting base includes a series of protrusions within at least one of the slots. The protrusions are spaced from one another to define a series of depressions, each capable of receiving a part of one of the hooks. The protrusions resist movement of the hook along the length of the slot, but each protrusion is resiliently movable as a whole so that the hooks can move from one depression to a next depression when a rotational force is applied to the light module.

In a preferred embodiment, the front face of the mounting base has first and second opposite edges. One of the slots extends to the first edge, and the hook entry clearance for that slot is formed by an end opening thereof at the first edge. Similarly the other slot extends to the second edge, and its hook entry clearance is formed by an end opening thereof at the second edge.

Preferably, the mounting base includes a sheet of spring metal contained in a polymeric resin housing, the slots are formed in the polymeric resin housing, and the series of protrusions is formed on the sheet of spring metal. The sheet of spring metal can be supported within the mounting base with a space behind its series of protrusions on a side thereof facing toward the back side of the mounting base so that the protrusions are resiliently movable into that space. The sheet of spring metal is preferably formed with a set of fingers protruding from a common connecting part. In that case, each of the protrusions is formed on a different one of the fingers, and the sheet of spring metal is supported within the mounting base with a space behind the set of fingers on a side thereof facing toward the back side of the mounting base, so that the fingers are resiliently movable into said space.

In a preferred embodiment, the mounting base comprises first and second unitary polymeric resin parts fastened to each other, the first part being a front part and the second part being a back part. The sheet of spring metal on which the protrusions are formed is sandwiched between the first and second parts, and preferably supported within the mounting base with a space between the sheet of spring metal and the second part, whereby the protrusions are resiliently movable into the space.

In a preferred embodiment, the sheet of spring metal is formed with a set of fingers protruding from a common connecting part, and each of the protrusions is formed on a different one of the fingers. The sheet of spring metal is supported within the mounting base with a space behind the set of fingers on a side of the fingers facing toward the second part, whereby the fingers are resiliently movable into the space.

The protrusion nearest the entry clearance of at least one of the slots is preferably higher than the other protrusions, or otherwise configured to offer greater resistance than each of the other protrusions within that slot to rotation of the light module about its axis of rotation.

In a preferred embodiment, one of the light module and mounting base has a protrusion, and the other of the light module and mounting base has a depression. The protrusion extends into the depression, and the protrusion and depression cooperate with each other to limit rotation of the light module relative to the base to rotation about the axis of rotation when the hooks are engaged with the internal retaining surfaces of the slots.

The hooks of the light module are preferably diametrically opposed to each other on opposite sides of the axis of rotation, and the hook entry clearances are also opposed to each other on opposite sides of the axis of rotation. Thus, the light module can be engaged with the mounting base with the first hook extending into one of the slots and the second hook extending into the other slot, and alternatively with the first hook extending into said other slot and the second hook extending into said one of the slots.

For increased adjustability of the direction of light emitted by the light emitter, the light emitter can be mechanically connected to the housing of the light module by a malleable goose-neck coupling.

In a version of the adjustable light suitable for attachment to a helmet or similar supporting object, a clamping hook extends from the back side of the mounting base and has a clamping end opposed to and spaced from the back side of the mounting base. A screw extending through the mounting base is threaded into a part of the hook for pulling the clamping end toward the back side of the mounting base. The mounting base can thus be attached to an object by clamping a portion of the object between the back side of the mounting base and the clamping end of the clamping hook.

In preferred version of the adjustable light designed for attachment to an object by means of a clamping hook, the mounting base has a central depression, and the light module has a protrusion extending into the central depression. The protrusion and depression cooperate with each other to limit rotation of the light module relative to the base to rotation about an axis of rotation when the hooks are engaged with the retaining surfaces. The screw has a screw head located within the central depression and a shank extending through the mounting base along the axis of rotation and threaded into a part of the hook for puling the clamping end of the hook toward the back side of the mounting base. The head of the clamping screw is accessible for adjustment of the clamping screw when the light module is removed from the mounting base.

Other advantageous features that can be incorporated into the mounting base relate to details of the structure of the mounting base and the protrusions that resist movement of the hooks along the slots.

The second part of the mounting base can be formed with a ring protruding toward the front face of the mounting base. The ring engages a part of the sheet of spring metal and maintains spaces behind both series of protrusions on a side thereof facing toward the second part so that the protrusions of each series are resiliently movable into one of these spaces.

An inner ring protruding from the second part toward the front face of the mounting base and concentric with the space-maintaining ring can fit a circular hole in the sheet of spring metal and prevent radial movement of the sheet relative to the axis of rotation of the light module.

As an alternative to the clamping hook, a pair of opposed, elongated, parallel, elements can extend from the back side of the mounting base. These elements have mutually facing, parallel, V-shaped slots for receiving conforming V-shaped edges of a mounting rail. A clamping screw connects one of the parallel elements to the other and is adapted to urge one of the parallel elements toward the other to clamp the mounting base on the mounting rail.

In another alternative, a flap hinged to the back side of the mounting base is provided to engage a length of flexible webbing on the exterior of an article of apparel in order to mount the adjustable light on the article of apparel.

Details of the adjustable light according to the invention, as well as its many objects and advantages, will be apparent from the following detailed description when read in conjunction with the drawings.

DETAILED DESCRIPTION OF THE PREFERRED EMBODIMENTS

The adjustable light of the invention comprises as its basic elements a mounting base and a self-contained light module which can be quickly and easily attached to, and removed from, the mounting base, and which can be easily turned on and off and easily adjusted to any desired elevational angle in order to project light in a desired direction. The adjustable light has utility in a wide variety of applications, and especially applications in which the light is worn on an article of headgear or other article of apparel.

Figure 1:
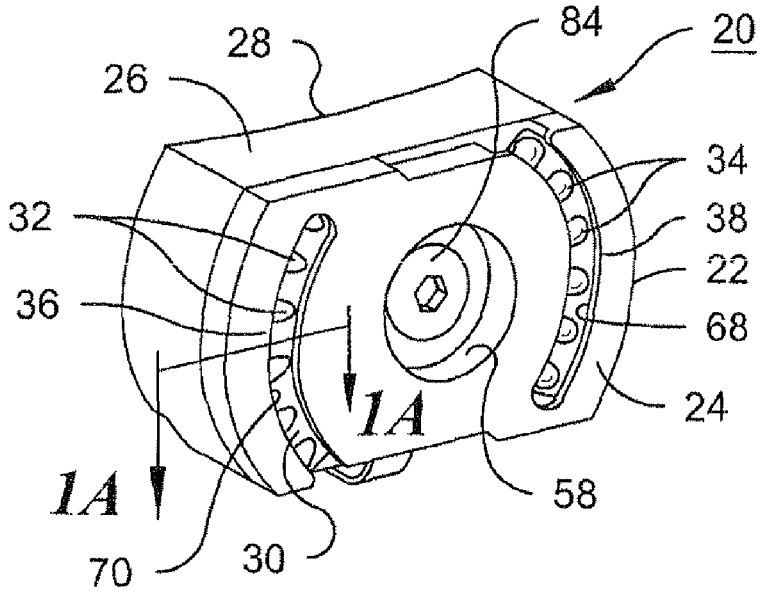
FIG. 1 is a perspective view of a first embodiment of a base for an adjustable light.

The mounting base 20, shown in FIG. 1, comprises three parts. A first, or front, part 22 having a front face 24, and a second, or back part 26, having a back face 28, are preferably composed of a molded polymeric resin such a polyamide resin, for example NYLON 66. Sandwiched between parts 22 and 26 is a plate 30 of spring metal, preferably 300 stainless steel. The plate 30 has two series of protrusions, 32 and 34. The protrusions are spaced from one another at regular intervals and exposed respectively through arcuate slots 36 and 38 in the front part 24 of the mounting base.

Figure 1A:
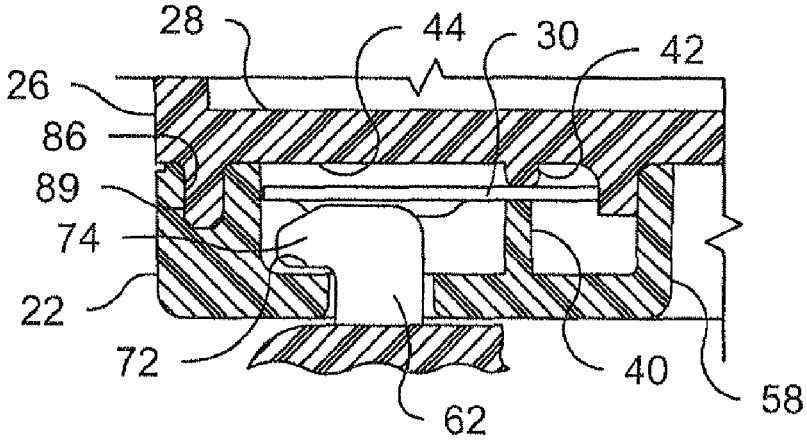
FIG. 1A is a cross-sectional view taken on section plane 1A-1A in FIG. 1.

As shown in FIG. 1A, the plate 30 is held between an annular ridge 40, formed on the front part 22, and an annular ridge 42 formed on the back part 26. Ridge 42 maintains the plate 30 in spaced relationship to a wall 44 on part 26, allowing the part of the plate 30 on which the protrusions are formed to deform and bend toward wall 44.

Figure 2:
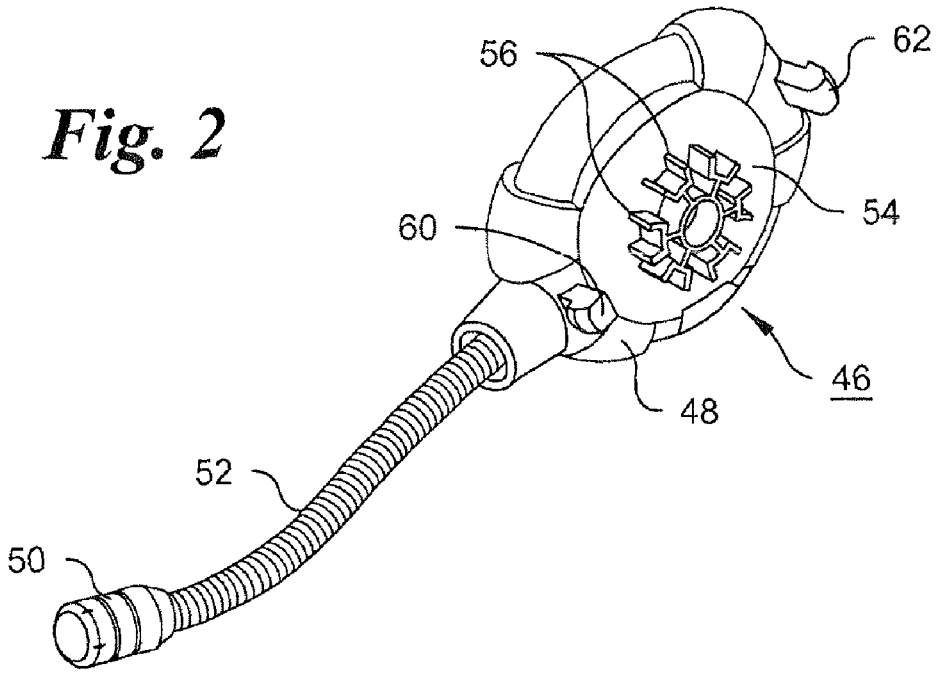
FIG. 2 is a perspective rear view of a light for attachment to the base.

As shown in FIG. 2, the light module 46 comprises a body 48. A light emitter, preferably a light-emitting diode (LED) assembly 50 is connected mechanically to the light module body 48 through a flexible "goose-neck" coupling 52, which allows the position of the LED assembly 50 to adjusted in order to adjust the direction in which light is emitted by LED assembly 50. The goose-neck coupling is malleable, i.e., it can be bent manually, and holds the position to which it is bent with little or no backlash. Electrical current is delivered to the LED assembly by one or more conductors (not shown) that extend through the goose-neck coupling to a power source, which can consist of one or more electrochemical cells located in a compartment inside body 48. A removable battery cover 54 on the rear part of the light module closes the compartment and provides access to the power source. The battery cover is formed with an array of protrusions 56 that have outer ends disposed in a circle. As shown in FIG. 1, the front part 22 of the mounting base has a circular central opening 58 which is coaxial with arcuate slots 36 and 38. The diameter of opening 58 corresponds to the circle defined by the outer ends of protrusions 56 in FIG. 2, allowing the protrusions 56 to fit opening 58 when the light module is attached to the mounting base, preventing translational movement of the light module and limiting its movement to rotation relative to the mounting base about an axis of rotation extending through the center of opening 58.

As seen in FIG. 2, two hooks, 60 and 62, are formed on the back of the light module 46, and are preferably molded as a unit with the back of the light module. The hooks are positioned so that they extend through slots 36 and 38 when the light module is connected to the mounting base with its protrusions 56 fitting into central opening 58. The hooks enter slots 36 and 38 through clearances provided by end openings 64 and 66, and hold the light module to the mounting base by engagement with undercut internal retaining surfaces formed along the outer elongated arcuate edges 68 and 70 of the slots. One such retaining surface is surface 72, which, as shown in FIG. 1A, is in engagement with an outwardly protruding end part 74 of hook 62. As an alternative, the hooks can be formed with their end portions protruding radially inward and engageable with undercut retaining surfaces extending along the inner elongated arcuate edges of the slots.

The hooks are preferably positioned diametrically on opposite sides of the circle defined by battery cover protrusions 56 so that they can enter the end openings 64 and 66 of the slots simultaneously, and so that the light module can be engaged with the mounting base in either of two ways: with hook 60 extending into slot 38, and hook 62 extending into slot 36 as shown in FIG. 1A, or with hook 60 extending into slot 36 and hook 62 extending into slot 38.

Figure 3:
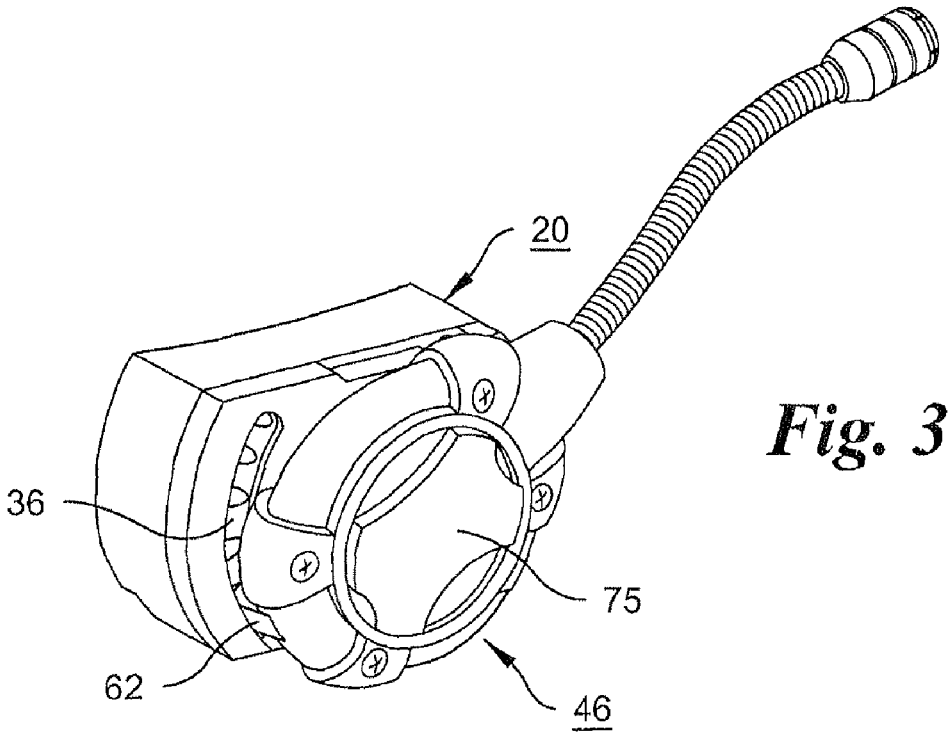
FIG. 3 is a perspective view of the base with the light attached and tilted upward.
Figure 4:
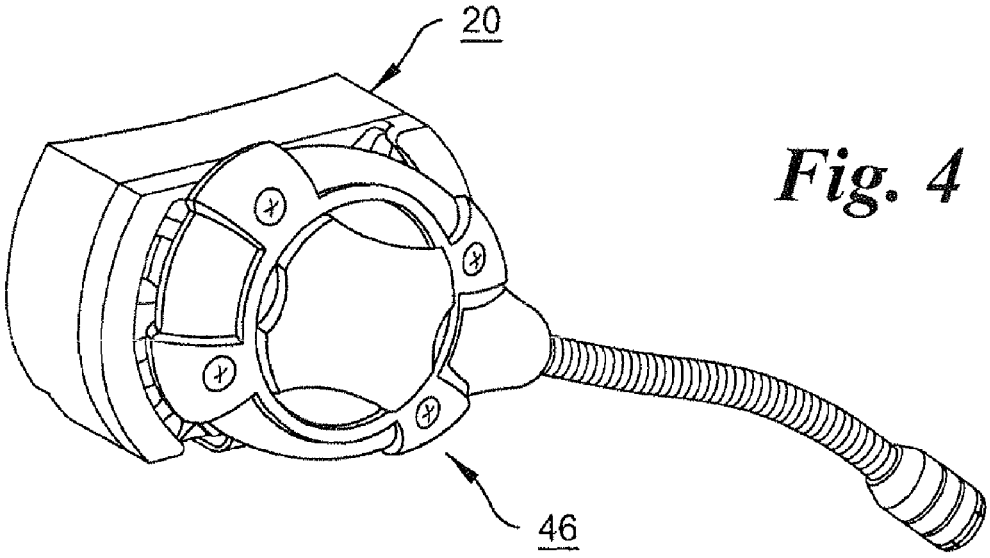
FIG. 4 is a perspective view of the base with the light attached and tilted downward.

FIG. 3 shows the light module 46 attached to the mounting base with its hook 62 in slot 36. The light module is tilted upward in FIG. 3 and tilted downward in FIG. 4. A push-button 75 can be used to turn the LED on and off, and, optionally, to select a brightness level from several possible choices, and to select a particular flashing mode from two or more choices. A microchip-based controller can be associated with the push-button to enable the user to select a desired mode of operation. An example of such a controller is described in U.S. Pat. No. 6,650,066, granted Nov. 18, 2003, the disclosure of which is incorporated by reference.

Figure 5:
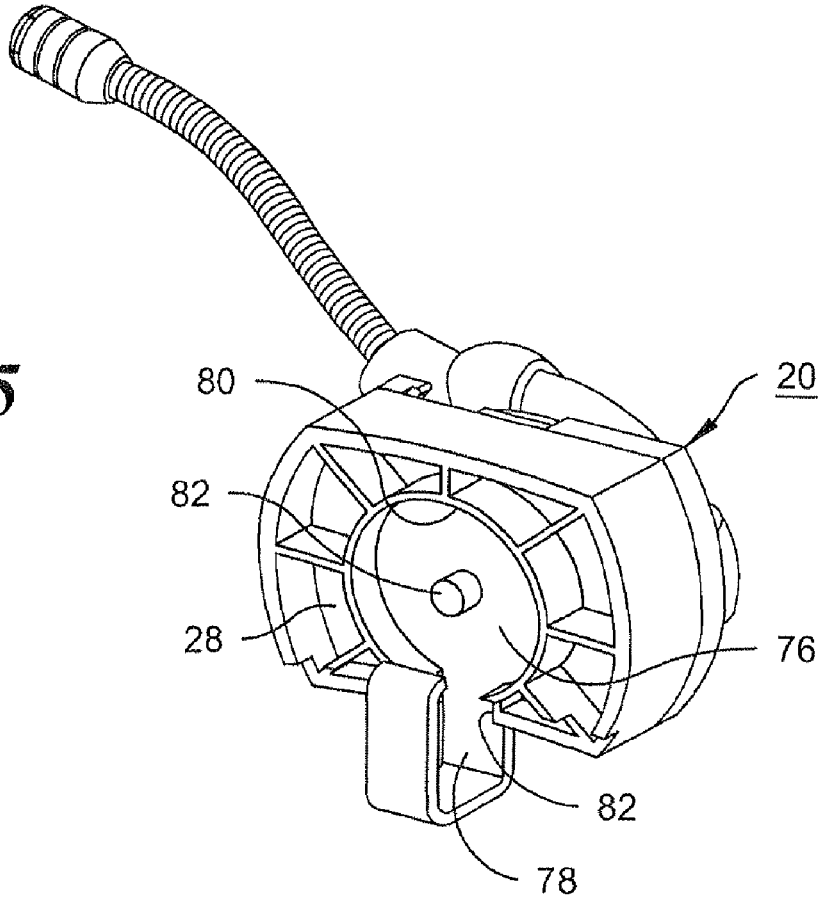
FIG. 5 is a rear perspective view showing the base and light of FIG. 3, and also showing a helmet clip on the base.
Figure 6:
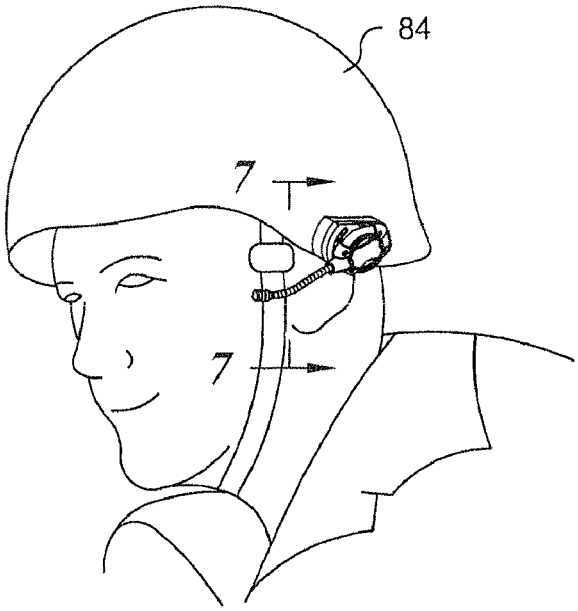
FIG. 6 is a view showing the light worn on a helmet.
Figure 7:
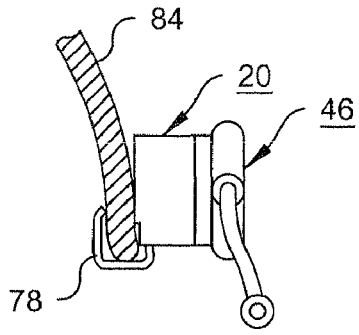
FIG. 7 is a sectional view showing details of the attachment of the light to a helmet.

FIG. 5 shows the back side of the mounting base. A back part 76 of a hook 78 fits into a recess 80 and is prevented from rotation in recess 80 by the walls of an extension of the recess, one such wall being shown at 82. The back part 76 is threaded onto a screw 82, the head 84 of which, as shown in FIG. 1, is recessed in, and accessible through, central opening 58 of the mounting base when the light module is removed. The screw can be a conventional slotted screw or a Phillips screw. Alternatively, it can have any of various kinds of heads, such as a head having a hexagonal recess (as shown in FIG. 1) for receiving an Allen wrench. When rotated, the screw pulls hook 78 toward the back face 28 of the mounting base, for attachment of the mounting base to a helmet 84 as shown in FIGS. 6 and 7. With the mounting base firmly attached to a helmet or other article, the light module can be readily attached to the mounting base by inserting the hooks into the ends of the slots 36 and 38 and rotating the light module to engage the hooks with the undercut surface 72 extending along slot 36 and a corresponding undercut surface (not shown) extending along slot 38.

Figure 8:
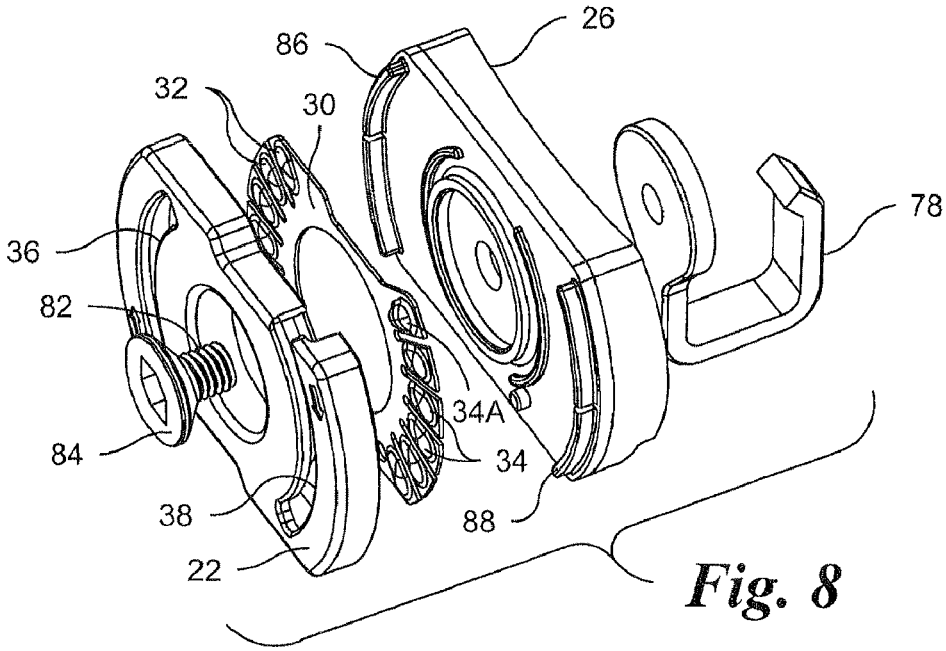
FIG. 8 is an exploded perspective view of the helmet bracket.

Details of the structure of the mounting base are shown in exploded view in FIG. 8.

As shown in FIG. 8, a pair of arcuate ridges 86 and 88 are formed on the front face of the back part 26 of the mounting base. These ridges fit into conforming arcuate slots (not shown in FIG. 8) in the back face of front part 22. Ridge 86 is also shown in FIG. 1A in slot 89.

Protrusion 34A, which is the protrusion of series 34 on plate 30 closest to the entrance opening of slot 38 extends forward slightly farther than the other protrusions of series 34 to impose greater resistance on the rotation of the light module. This greater resistance enables the user to distinguish it by feel from the other protrusions as the light module is rotated, and thereby enables the user to sense when the light module is about to be disengaged from the mounting base. For the same reason, the corresponding protrusion (not shown in FIG. 8) in series 32 adjacent the entrance of slot 36 extends forward slightly farther than the other protrusions of series 32. These enlarged protrusions also help prevent accidental disengagement of the light module from the mounting base.

The plate 30 is composed of spring metal, and each of its protrusions is formed on a finger so that the protrusions are independently movable by flexion of the fingers. The flexibility of the fingers, and the fact that they are spaced from the wall 44 of the back part of the mounting base as shown in FIG. 1A, provide for good control of the torque required to rotate the light module from one position to another, and the torque required to remove it from the mounting base.

Figure 9:
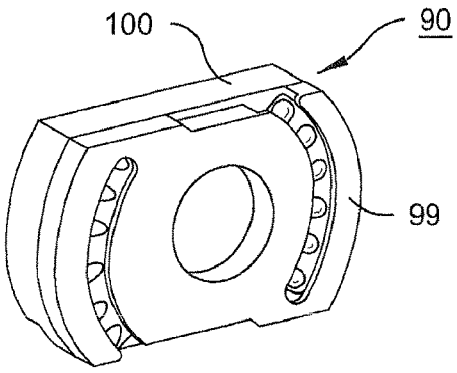
FIG. 9 is a perspective view of a second embodiment of the base.
Figure 10:
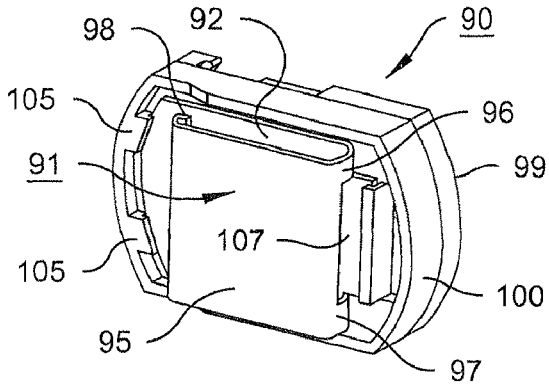
FIG. 10 is a rear perspective view of the base of FIG. 9.
Figure 11:
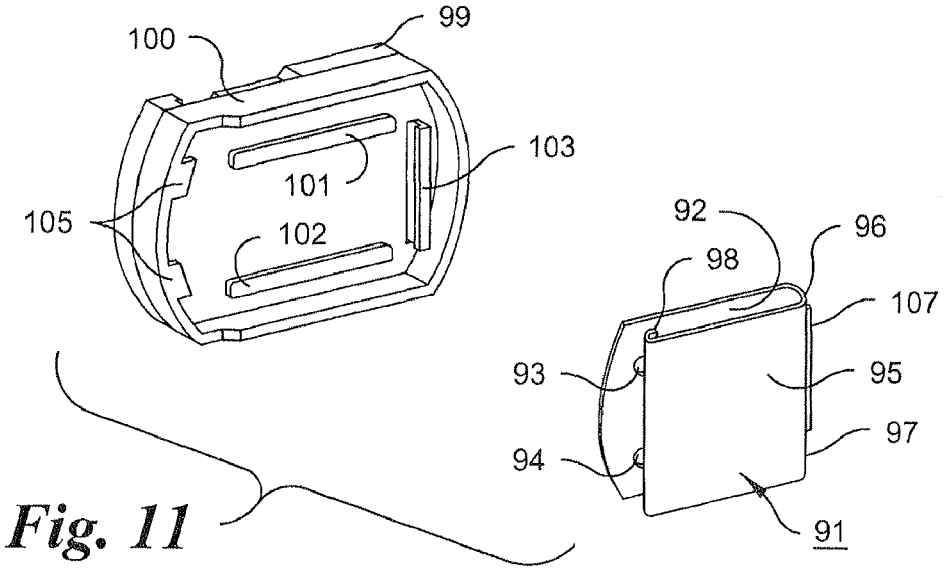
FIG. 11 is an exploded view of a rear part of the base of FIGS. 9 and 10.

In an embodiment of the invention shown in FIGS. 9-11, a mounting base 90 is provided with a clip 91 on its back side for attachment to a belt, a strap on a MOLLE vest, or the like. The clip 91 is preferably formed from a sheet of stainless steel, and comprises a back panel 92, having two slots 93 and 94, and a front panel 95 in parallel, spaced, relationship to the back panel. The front panel 95 is flexibly connected to the back panel by two bent parts 96 and 97 along one of its edges, and is formed with an inwardly bent hook 98 at its opposite edge. A tab 107 is formed by an outwardly bent rectangular part of the stainless steel sheet cut out from between bent parts 96 and 97.

The front part 99 of the mounting base can be substantially identical to the front part of the mounting base in the first embodiment. Formed on the back part 100, however, is a pair of elongated, parallel protrusions 101 and 102, that can fit into slots 93 and 94 in the back panel 92 of the clip. The tab 107 of the clip can be snapped underneath an L-shaped protrusion 103, formed as a unitary part of back part 100, and a curved edge 104 of back panel, opposite from bent parts 97 and 97, fits underneath protrusions 105 formed as unitary parts of part 100 of the mounting base.

The metal clip 91 can be easily and securely attached to the back part 100 of the mounting base, and used to connect the mounting base to a strap or belt. The inwardly bent hook 98 formed on the front panel 95 of the clip receives an edge of the strap or belt and prevents accidental loss of the mounting base. The light module used with the mounting base 90 can be the same as light module 46 in FIGS. 2, 3 and 4.

Figure 12:
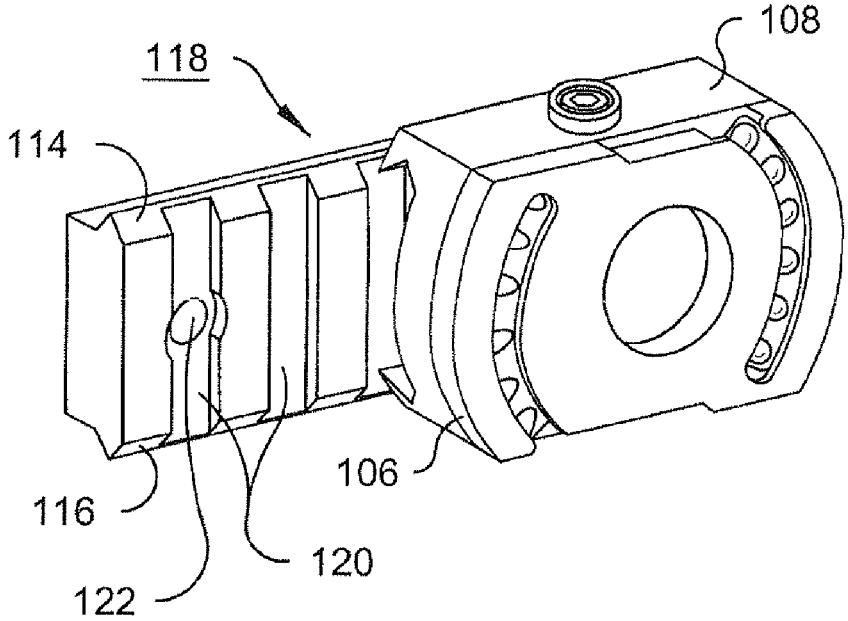
FIG. 12 is an exploded perspective view showing a third embodiment of the base and a rail to which the base can be attached.
Figure 13:
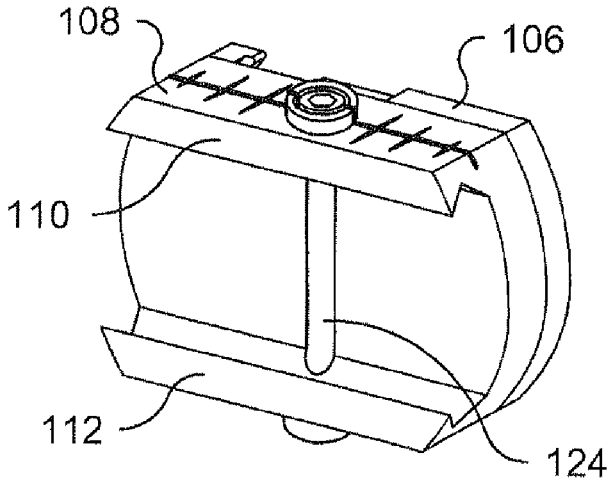
FIG. 13 is rear perspective view of the base of FIG. 12.

In third embodiment, shown in FIGS. 12 and 13 the mounting base is composed of two parts, a front part 106 and a back part 108. Front part 106 has two arcuate slots for engagement by hooks on a light module such as light module 46 in FIG. 2, and can be identical to front part 22 in the first embodiment and front part 100 in the second embodiment. The back part 108 has a wide lengthwise slot defined between opposed, elongated, parallel, elements 110 and 112 extending from its back side. These elements have mutually facing, parallel, V-shaped recesses for receiving conforming V-shaped edges 114 and 116 of a mounting rail 118, known as a "Picatinny Rail", a device widely used for mounting telescopic sights, and other accessories on rifles and other weapons. The mounting rail 118 has a series of transverse slots 120 extending from edge 114 to edge 116, and one or more mounting holes 122 for attachment to a surface. A clamping screw 124 connects parallel elements 110 and 112, and can be tightened to urge elements 110 and 112, which have a small degree of resilience, toward each other to clamp the mounting base on the rail. The clamping screw is removable from the mounting base, and when the mounting base is installed on the rail, the clamping screw extends through one of the transverse slots 120 on the rail to lock the mounting base positively on the rail. Thus, even if the screw loosens sufficiently to allow the mounting base to slide, sliding of the mounting base along the rail is limited by engagement of the clamping screw with one side or the other of the slot 120 through which it extends.

The slotted part of the mounting base, the sheet of spring metal, and of course, the light module, can be utilized without modification in any of the three embodiments specifically described as well as in various other embodiments. It is only necessary to adopt a mounting base configuration suitable for attachment to the particular surface or article on which the adjustable light is to be mounted. Various other modifications can be made to the mounting base as well as to the light module. For example, the arcuate slots of the mounting base need not have end openings as in FIG. 1. Instead, the slots can be closed at both ends, and enlarged at their ends to provide clearance for entry of the hooks of the light module. Although the light module preferably has its light emitter located at an end of a flexible goose-neck coupling, the coupling can be rigid, or eliminated altogether so that the light emitter is directly mounted on the body of the light module. Various forms of switches other than push-button 75 can be used to control the light module. The light emitter can be used for various purposes other than ordinary illumination. For example it can be used for signalling, and can emit light in any of various visible colors as well as radiation outside the visible spectrum such as infrared or ultraviolet light.

What is claimed is:

1. An adjustable comprising:

a light module comprising a housing, a light emitter, an electric power source, and a switch for selectably connecting the power source to the light emitter; and a mounting base having a back part attachable to a supporting article and a front part on which the light module is removably mountable;

in which the front part of the mounting base is formed with a pair of slots, each slot having an elongated arcuate edge extending along its length, said arcuate edges being concentric, and said slots being undercut along said elongated arcuate edges whereby each slot has an internal retaining surface extending along its elongated arcuate edge and facing toward said back part of the mounting base;

in which the light module has first and second hooks protruding therefrom, extending respectively into said slots, and engaging the respective internal retaining surfaces of said slots to prevent separation of the light module from the mounting base while permitting rotation of the light module relative to the base about an axis of rotation extending through a center point defined by said concentric arcuate edges;

in which each of the slots has a hook entry clearance at one of its ends, said clearances permitting entry of said hooks into the slots by movement of the light module in the direction of said axis of rotation followed by rotation of the light module, and in which the arcuate edges of said slots extend from said clearances in the same circumferential direction, whereby the hooks can be engaged with the retaining surfaces by rotation of the light module in said circumferential direction;

in which the mounting base includes a series of protrusions accessible by at least one of said hooks through least one of said slots, said protrusions being spaced from one another to define a series of depressions, each depression being capable of receiving a part of one of said hooks, said protrusions resisting movement of said one of said hooks along the length of said at least one slot, but each protrusion being resiliently movable as a whole whereby said one of said hooks can move from one depression to a next depression when a rotational force is applied to the light module:

in which the mounting base includes a sheet of spring metal contained in a polymeric resin housing, the slots are formed in the polymeric resin housing, and the series of protrusions is formed on the sheet of spring metal; and in which the sheet of spring metal is supported within the mounting base with a space behind said sheet of spring metal, between said sheet of spring metal and the back part of the mounting base, whereby said protrusions are resiliently movable into said space.

2. An adjustable light according to claim 1, in which the sheet of spring metal is formed with a set of fingers protruding from a common connecting part, in which each of said protrusions is formed on a different one of said fingers, and in which said space behind said sheet of spring metal is located behind said set of fingers on a side of said fingers facing toward the back part of the mounting base, whereby said fingers are resiliently movable into said space.

3. An adjustable light according to claim 1, in which comprising:

in which said housing comprises first and second unitary parts each composed of a polymeric resin, said parts being fastened to each other, and in which said sheet of spring metal is sandwiched between said first and second parts.

4. An adjustable light according to claim 3, in which the back part of the mounting base is formed with a spacer ring protruding toward the front part of the mounting base, said ring engaging a part of said sheet of spring metal and maintaining said space.

5. An adjustable light according to claim 4, in which the second part is formed with an inner ring concentric with said spacer ring and protruding toward the front face of the mounting base, the inner ring fitting a circular hole in said sheet of spring metal and preventing radial movement of said sheet relative to said axis of rotation.

6. An adjustable light comprising:

a light emitter;

an electric power source;

a switch for selectably connecting the power source to the light emitter:

a helmet adapted to be worn on the head of a person; and a flexible, malleable, goose-neck coupling mechanically connecting the light emitter to said helmet;

whereby the direction toward which the light is emitted by the light emitter can be adjusted by bending of the flexible, malleable goose-neck coupling; and in which said goose-neck coupling is connected to the helmet by a mounting base comprising a first part connected to the helmet and a second part connected to the goose-neck coupling at a location spaced from the light emitter, and in which said first part is rotatable relative to the second part about an axis of rotation.

* * * * *